US006071129A

United States Patent [19]

Konno et al.

[11] Patent Number: 6,071,129

[45] Date of Patent: Jun. 6, 2000

[54] CONNECTOR SOCKET WITH CONTACT ENLARGED BASE SECTIONS INSERTED IN HOLDING CHAMBER ATTACHMENT GROOVES AND STOPPING PROJECTIONS IN CHAMBER TO PREVENT CONTACT FROM BEING WITHDRAWN FROM CHAMBER

[75] Inventors: Takeshi Konno; Shuichi Sasajima, both of Ibaraki-ken, Japan

[73] Assignee: Mitsumi Electric Co., Ltd., Japan

[21] Appl. No.: 09/153,139

[22] Filed: Sep. 15, 1998

[30] Foreign Application Priority Data

Oct. 30, 1997 [JP] Japan ..... 9-314294

[51] Int. Cl.[7] ..... H01R 12/00

[52] U.S. Cl. ..... 439/74

[58] Field of Search ..... 439/74, 55, 660, 439/637, 636

[56] References Cited

U.S. PATENT DOCUMENTS 4,162,516 7/1979 Becker ..... 361/372

5,192,232 3/1993 Lenz et al. ..... 439/660

5,556,286 9/1996 Ikesugi et al. ..... 439/74

5,609,502 3/1997 Thumma ..... 439/747

5,800,214 9/1998 Pratt et al. ..... 439/637

*Primary Examiner*—Lincoln Donovan

*Assistant Examiner*—Michael C. Zarroli

*Attorney, Agent, or Firm*—Morrison Law Firm

[57] ABSTRACT

A connector socket positions its contacts within contact holding chambers. In order to limit excessive outward movement of the contacts during withdrawal of a connector plug, a center stopper projects sideways from the contact, and engages an engagement surface molded into the interior of the contact holding chamber. An end projection is bent at an inner end of the contact. The end projection is positioned behind a projection molded into the interior surface of the contact holding chamber. Engagement of the end projection with the projection prevents the end of the contact from excessive outward movement during withdrawal of a mating plug. In this way, both the center and the end of the contact are retained in place.

2 Claims, 5 Drawing Sheets

CONNECTOR SOCKET WITH CONTACT ENLARGED BASE SECTIONS INSERTED IN HOLDING CHAMBER ATTACHMENT GROOVES AND STOPPING PROJECTIONS IN CHAMBER TO PREVENT CONTACT FROM BEING WITHDRAWN FROM CHAMBER

BACKGROUND OF THE INVENTION

The present invention relates to an electrical connector. More specifically, the present invention relates to a connector socket used in conjunction with a connector plug.

Referring to FIG. 5, there is shown a car stereo. A well-known method for preventing a car stereo from being stolen from a parked car involves a front panel Y that is detachable from a main stereo unit X. When the car is parked, front panel Y, on which buttons and the like are mounted, is removed and carried. A potential thief, looking through the car window fails to see a fully functional car stereo, and is thus discouraged from breaking into the car and stealing.

The dotted lines with double dashes in FIG. 5 illustrate an equipment with a removable hinge attached to one side of main stereo unit X, which is longer horizontally than vertically.

Referring to FIG. 6, a connector plug P and a connector socket S are disposed on front panel Y and main stereo unit X to provide electrical contact between main stereo unit X and front panel Y.

A connector socket S used in this manner includes a connector mold A that is longer horizontally than vertically. A horizontal plug insertion opening C is formed on the surface of connector mold A to receive a plug section B of connector plug P, which is attached to the back surface of front panel Y.

A plurality of connector pairs D1, D2 are disposed within connector mold A in a symmetrical arrangement relative to plug insertion opening C. Connectors D1, D2 include pressure-contact ends d1, which are able to come into contact with plug contacts b of plug section B.

Connector mold A is open on the side facing main stereo unit X. These contacts are mounted in connector mold A from the back side of connector mold A. Positioning projections are formed on attachment bases d2 and are fixed to attachment groove, E1, E2, which are disposed from front to back in connector mold A. Pressure-contact ends d1, which are continuous with U-shaped deformation absorbers d3, project inside plug insertion opening C.

In conventional contacts, external connection terminals d4 are bent vertically at right angles after attachment base d2 is attached to attachment grooves E1, E2. External connection terminals d4 are then soldered in main stereo unit X to the printed circuit substrate or the like to which connector mold A is fixed.

Some recent car stereos use a "bottom hinge" to attach front panel Y to main stereo unit X, as indicated in the dotted lines with single dashes from FIG. 5. Referring to FIG. 6, connector socket S as described above increases the difficulty in providing electrical connection with front panel Y when a bottom hinge is used.

With a bottom hinge structure, plug section B of connector plug P is inserted into plug insertion opening C along an arcuate path having a center of rotation positioned toward the bottom. Thus, simply forming pressure-contact ends d1 on connectors DI, D2 does not allow pressure-contact ends d1 to adequately follow and be deformed during the arcuate travel on the complex insertion path of plug section B. Such inadequate deformation of pressure-contact ends d1 may result in bad contact between contacts with D1, D2.

One way to overcome this problem of bad contact is to provide greater flexure by making pressure-contact ends d1 of contacts DI, D2 more elastic. However, when plug section B is disengaged from plug insertion opening C, the friction between pressure-contact ends d1 and plug contacts 6U, 6L can cause pressure-contact ends d1 to be deformed, resulting in plastic deformation of contacts D1, D2. Increasing the elasticity of contacts D1, D2 makes this problem worse.

OBJECTS AND SUMMARY OF THE INVENTION

The object of the present invention is to provide a socket connector which overcomes the drawbacks of the prior art.

It is a further object of the invention to provide a connector socket in which the contacts do not become deformed, that can handle the complex motion path of a mating plug section, and that has flexibly deformable contacts.

In order to achieve the objects described above, the present invention proposes a connector socket that includes a long, thin connector mold having a surface on which is formed a plug insertion opening for receiving a plug section of a long, thin connector plug. A plurality of pairs of contacts are mounted inside the connector mold and are arranged facing each other along a direction perpendicular to the length of the connector mold. The contacts include deformable pressure-contact ends which can be pressed into contact with plug contacts on the plug section. The contacts are held in contact holding chambers. The contacts are integrally formed with center stoppers, which are formed as wide, center portions of the contacts. An engagement surface is formed on an inner wall surface of the contact holding chambers, and displacement of the center stopper is restricted by engagement between the center stopper and the engagement surface.

In the description of the preferred embodiments of the present invention presented below, the contact holding chambers open to opposite surfaces of the connector mold, rather than toward the rear, as in the prior art. Enlarged base sections of the contacts are fixed to base attachment grooves extending in the direction of the opposite surfaces. The center stoppers engage engagement surfaces formed on center engagement openings. The center engagement openings are formed from the opposite surfaces to an inner wall surface of the contact holding chamber. There is also described a structure wherein a small stopping projection is projected inside the contact holding chamber. An end projection formed integrally on each of the pressure-contact ends of the contacts engages with the stopping projection.

Briefly stated, the present invention provides a connector socket that positions its contacts within contact holding chambers. In order to limit excessive outward movement of the contacts during withdrawal of a connector plug, a center stopper projects sideways from the contact, and engages an engagement surface molded into the interior of the contact holding chamber. An end projection is bent at an inner end of the contact. The end projection is positioned behind a projection molded into the interior surface of the contact holding chamber. Engagement of the end projection with the projection prevents the end of the contact from excessive outward movement during withdrawal of a mating plug. In this way, both the center and the end of the contact are retained in place.

According to an embodiment of the invention, there is provided a connector socket comprising: a connector mold, a plug insertion opening on a surface of said connector mold for receiving a plug section of a connector plug, at least one contact holding chamber in said connector mold, a pair of contacts disposed within in said contact holding chamber, said pair of contacts facing each other along a direction perpendicular to a length of said connector mold, said pair of contacts including deformable pressure-contact ends that are pressed into contact with a plug contact of said plug section when said connector plug is inserted into said plug insertion opening, a center stopper integrally formed on each of said contacts, said center stopper being on an intermediate portion of said contacts, said center stopper is wider than an adjacent portion of said contact, an engagement surface on an inner wall surface said contact holding chamber, and said engagement surface being positioned to engage said center stopper to restrict displacement of said center stopper beyond a predetermined displacement, whereby excessive displacement of said contacts during withdrawal of said plug contact is prevented.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Referring to FIG. 1 through FIG. 4, the following is a detailed description of the embodiments of the present invention.

The connector socket of the embodiment shown in the figures has a structure suited for a front panel Y that is attached to a main stereo unit X by a bottom hinge.

Figure 1:
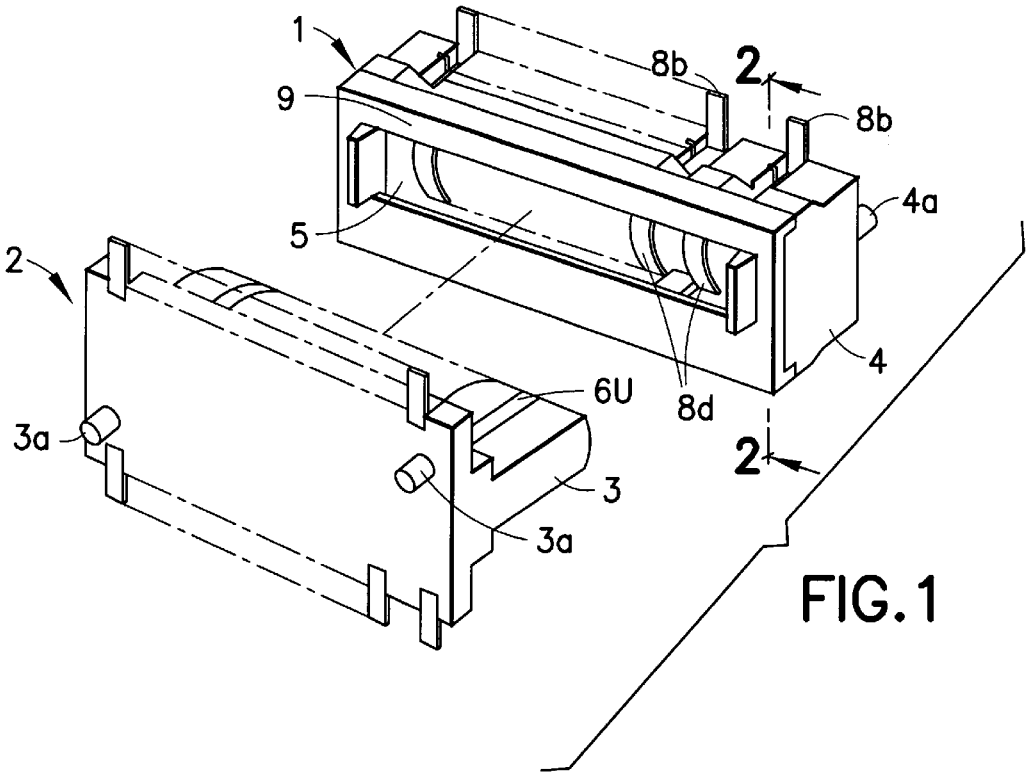
FIG. 1 is a perspective drawing showing the relationship between the connector socket and the connector plug.
Figure 2:
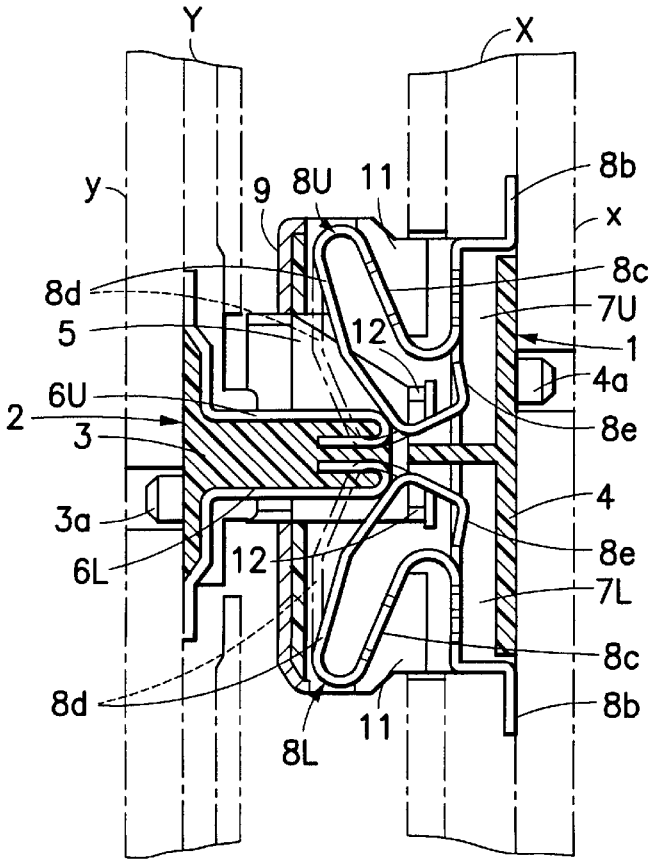
FIG. 2 is a cross-section drawing along line 2—2 in FIG. 1 showing the relationship between the connector socket and the connector plug.

Referring to FIG. 1 and FIG. 2, a connector socket 1 according to the present invention is fixed to the front surface of main stereo unit X of a car stereo. A connector plug 2 connected to connector socket 1 is fixed to a back surface of a front panel Y of the car stereo.

A plug section 3 of connector plug 2 includes a positioning pin 3a to provide positioning relative to a printed circuit substrate y. Plug section 3 is inserted along an engagement path K into a plug insertion opening 5, which is formed on the surface of a connector mold 4, to be described later, of connector socket 1.

Referring to FIG. 2, plug section 3 extends in a direction perpendicular to the plane of the page. Multiple pairs of plug contacts 6U, 6L are exposed on the upper and lower surfaces of the front end of plug section 3. Plug contacts 6U, 6L are arranged in rows perpendicular to the plane of page.

Connector mold 4, which is molded from an insulating resin, is positioned by a positioning pin 4*a* and fixed to a printed circuit substrate x of main stereo unit X.

Pairs of contact holding chambers 7U, 7L are formed side-by-side as upper and lower rows extending perpendicular to the plane of the page. Multiple pairs of contacts 8U, 8L are placed from above and below connector mold 4 into contact holding chambers 7U, 7L. Contacts 8U, 8L are arranged so that there is symmetry between the upper and lower portions of plug section 3.

A plug insertion opening 5 is formed on the front surface of connector mold 4 to receive plug section 3. Plug insertion opening 5 is formed continuously with contact chambers 7U, 7L. Plug insertion opening 5 is disposed toward the upper section asymmetrically relative to contacts 8U, 8L. The reason for this is that when front panel Y has a bottom hinge, engagement path K for plug section 3 forms, as seen, e.g., In FIG. 1 an arcuate path having a center of rotation below connector mold 4. The asymmetrical positioning of plug insertion opening 5 allows the end of plug section 3 to be inserted without obstruction. Furthermore, by making vertical opening width W of plug insertion opening 5 as small as possible, the insertion of a charged fingertip or foreign object into plug insertion opening 5 is prevented.

A shield plate 9 is positioned around plug insertion opening 5 to cover the entire front surface of connector mold 4. Thus, when an electrostatically charged fingertip is about to be inserted into plug insertion opening 5, the contact between the fingertip and shield plate 9 causes the static electricity on the fingertip to be grounded by shield plate 9.

Figure 3:
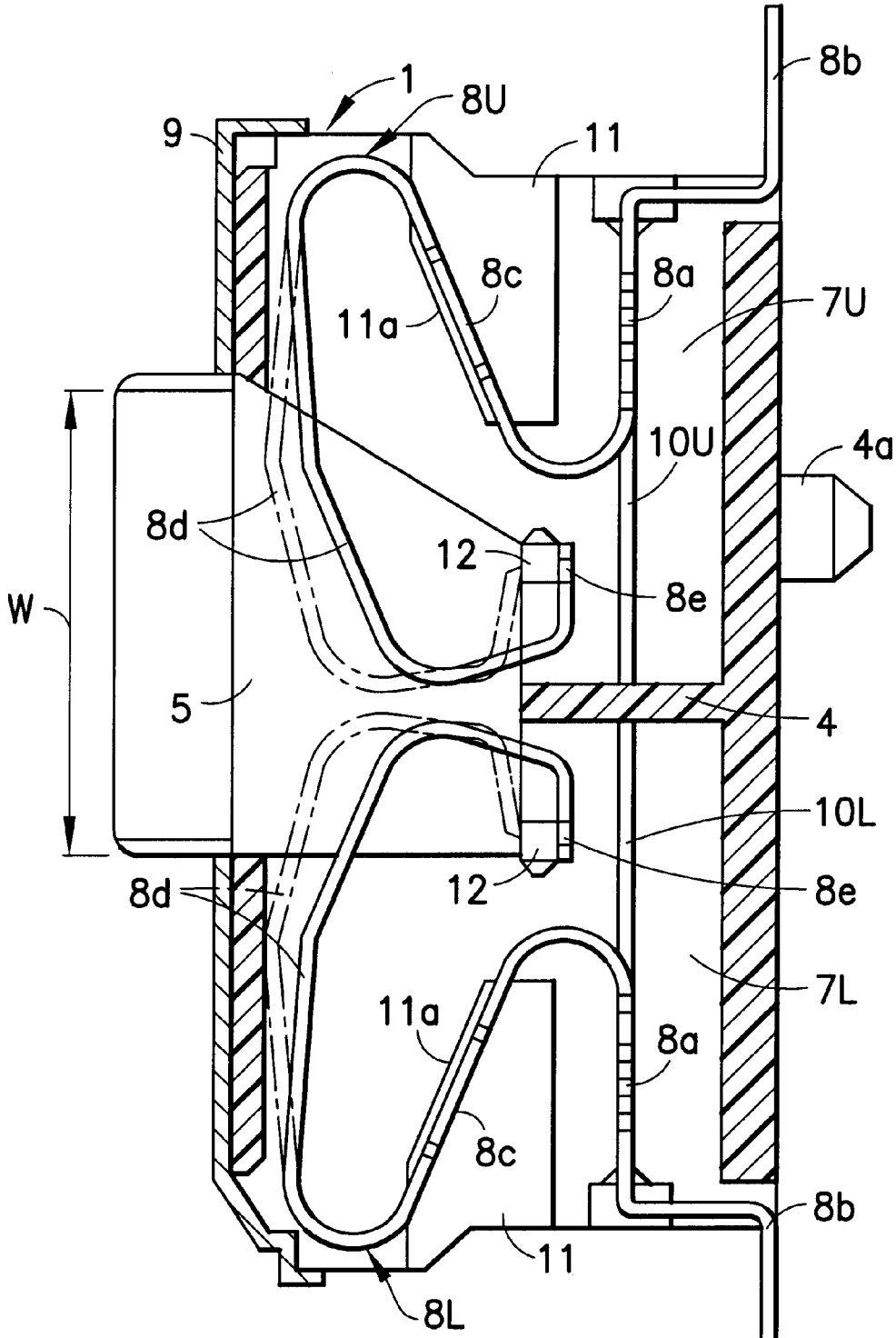
FIG. 3 is an enlarged cross-section drawing of the connector socket.
Figure 4:
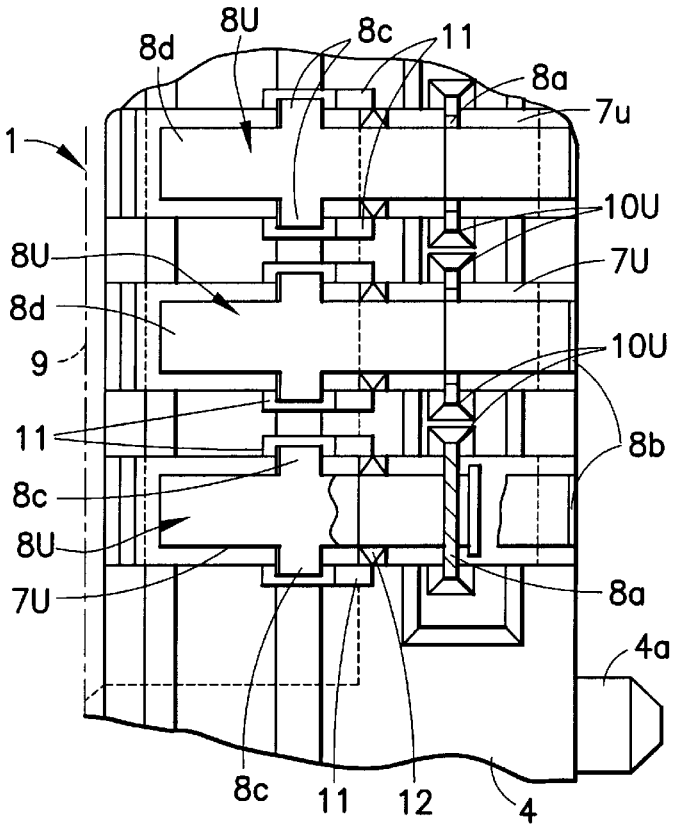
FIG. 4 is an enlarged top-view drawing of the connector socket.
Figure 5:
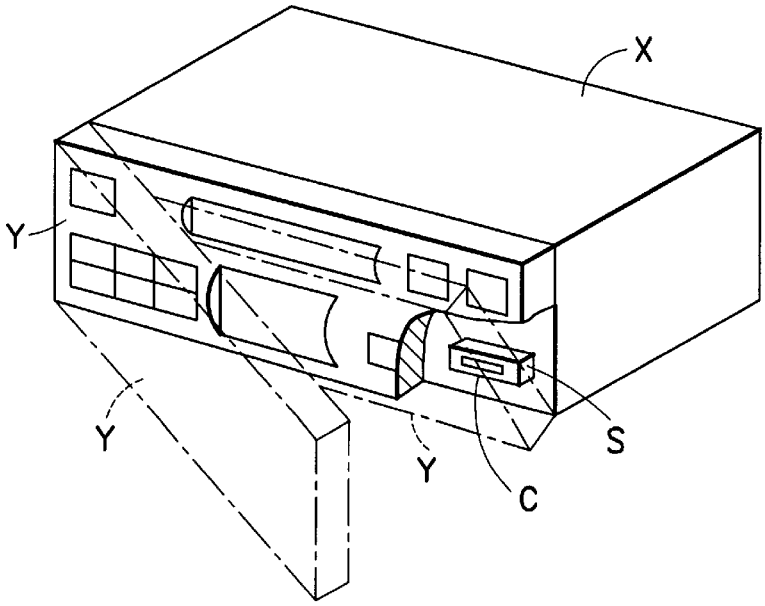
FIG.5 PRIOR ART
FIG. 5 is a perspective drawing of a conventional car stereo with a section cut away.
Figure 6:
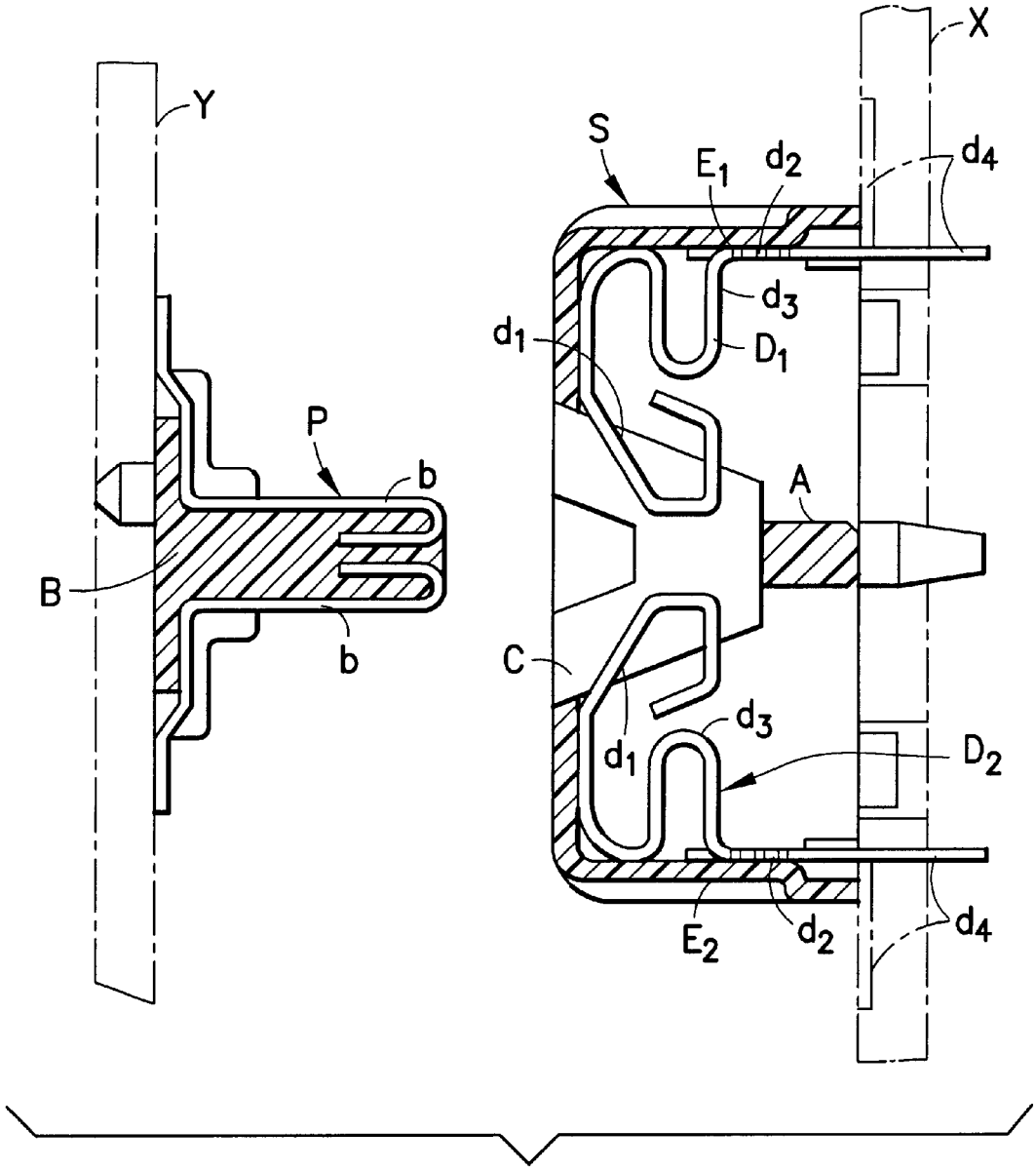
FIG.6 PRIOR ART
FIG. 6 is a perspective drawing showing the relationship between the connector socket and the connector plug in an example from the conventional technology.
Figure 7:
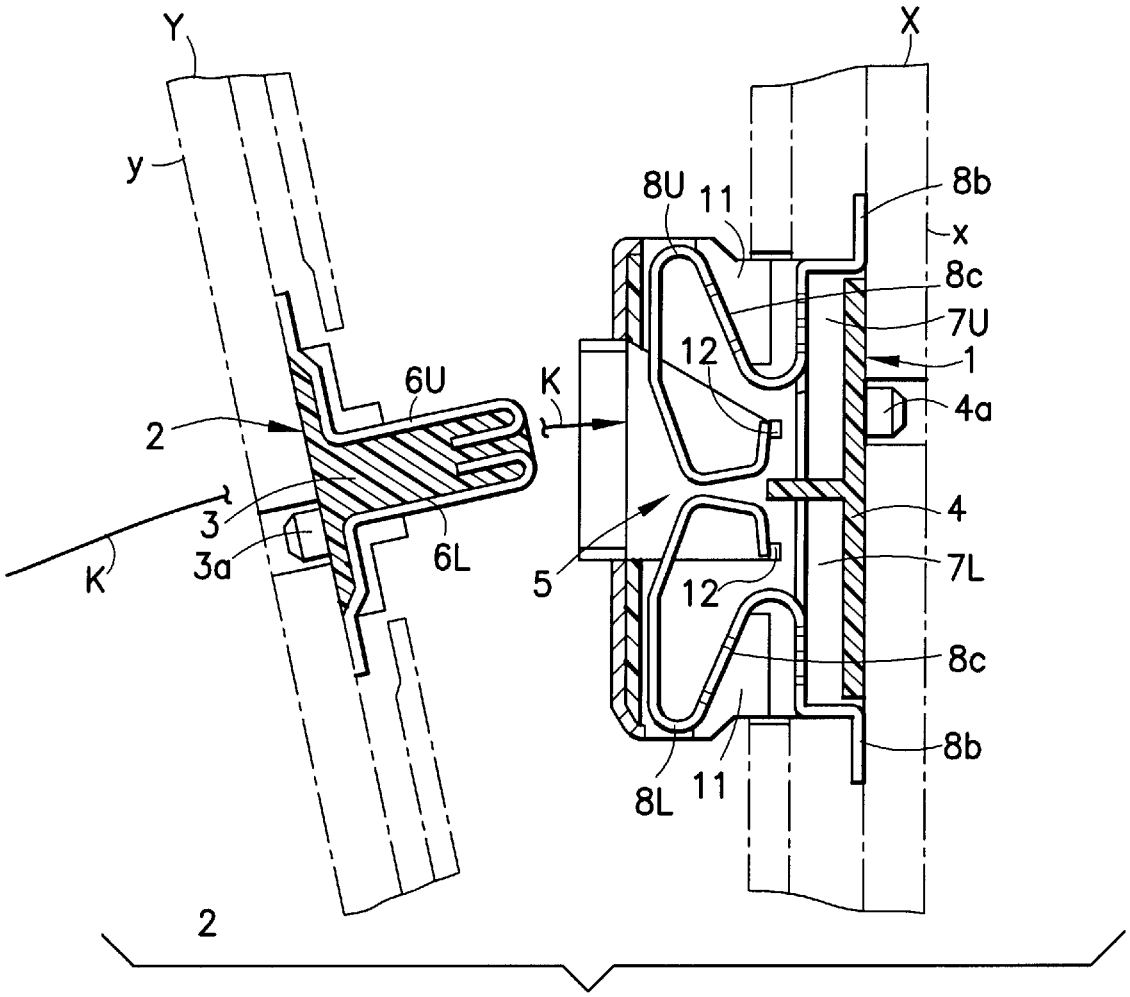
FIG. 7 is a side section view depicting the arcuate path insertion course which the connector plug follows when being inserted into the connector socket.

Referring to FIG. 3 and FIG. 4, the manner in which contacts 8U, 8L are attached is shown. Base enlargements 8*a* are formed as widened sections of contacts 8U, 8L. Base attachment grooves 10U, 10L are formed vertically on the inner wall surfaces of contact holding chambers 7U, 7L, which hold contacts 8U, 8L. Base attachment grooves 10U, 10L are formed so that base enlargement 8*a* of contacts 8U, 8L can be pressed into base attachment grooves 10U, 10L. Stopping projections formed on base enlargements 8*a* allow contacts 8U, 8L to be fixed inside contact holding chambers 7U, 7L.

Contacts 8U, 8L include external connection terminals 8*b*, which are continuous with base enlargement 8*a*. Before being attached to connector mold 4, external connection terminals 8*b* are bent right angles parallel to the back surface of connector mold 4. A pressing operation results in a bend on one side of base enlargement 8*a*, thus providing a precise bend for external connection terminal 8*b*.

Contacts 8U, 8L are formed with center sections that are bent away from base enlargements 8*a*. Center section stoppers 8*c*, which are disposed at these center sections, are positioned within center section engagement openings 11. Center section engagement openings 11 are formed from above and below on the inner walls of contact holding chambers 7U, 7L. An engagement section 11*a* on center section engagement opening 11 prevents center section stopper 8*c* from moving by forward (to the left in FIG. 3) by frictional engagement when plug section 3 is disengaged.

A bend resembling the bend in a hairpin is formed near the center sections of contacts 8U, 8L. An arcuate pressure-contact end 8*d* is exposed in plug insertion opening 5.

Pressure-contact end 8*d* is elastically deformed by plug section 3 of connector plug 2. An end projection 8*e* is formed at the end of pressure-contact end 8*d*. Stopping projections 12 that can engage end projection 8*e* are formed facing each other inside each of contact holding chambers 7U, 7L. This provides stable positioning of pressure-contact ends 8*d*.

Connector socket 1 according to the embodiment shown in the drawings is configured as described above and is assembled according to the steps described below.

A bending operation is performed using a press on contacts 8U, 8L. External connection terminals 8*b* at one end of base enlargements 8*a* are bent. Base enlargements 8*a* of contacts 8U, 8L are guided along base attachment grooves 10U, 10L from opposite sides to place contacts 8U, 8L in contact holding chambers 7U, 7L of connector mold 4. Referring to FIG. 3, base enlargements 8*a* of contracts 8U, 8L are pressed into and fixed in base attachment grooves 10U, 10L so that pressure-contact ends 8*d* of contacts 8U, 8L are positioned forward of stopping projections 12 as indicated by the dotted lines in FIG. 3.

Pressure-contact ends 8*d* of contacts 8U, 8L are deformed slightly to permit end projection 8*e* of pressure-contact end 8*d* to be displaced past corresponding projection 12. When the slight deformation is stopped, pressure-contact ends 8*d* are restored slightly due to elastic deformation to place pressure-contact ends 8*d* behind projection 12 to limit the outward movement of pressure-contact ends 8*d*. Thus, the connector can be assembled in a manner that prevents pressure-contact end 8*d* from moving too far outward when connector plug 3 is disengaged.

Also, assembly of contacts 8U, 8L of connector mold 4 does not require application of external force on external connection terminals 8*b* of contacts 8U, 8L. Thus, external connection terminals 8*b* can be bent accurately and kept parallel to the surface of printed circuit substrate x to which they will be attached.

In a car stereo installation, when plug section 3 is inserted into plug insertion opening 5, plug section 3 pushes apart pressure-contact ends 8*d* of contacts 8U, 8L, as indicated by the solid lines in FIG. 2. End projections 8*e* of pressure-contact ends 8*d* move away from projections 12. Contacts 8U, 8L, which correspond to plug contacts 6U, 6L of plug section 3 come into contact with pressure-contact end 8*d*, thus providing an electrical connection between main stereo unit X and plug 2.

When connector plug 2 is in the state shown in FIG. 2 and is then pulled out, pressure-contact ends 8*d* are drawn toward plug insertion opening 5 due to the friction of pressure-contact ends 8*d* of contacts 8U, 8L on plug contacts 6U, 6L. This motion is limited when center stoppers 8*c* of contacts 8U, 8L come into contact with engagement surface 11*a* of center section engagement opening 11. Thus excessive displacement of the center section is prevented and end projection 8*e* is reliably prevented from disengaging from projection 12 due to excessive deformation of pressure-contact end 8*d*.

In connector socket 1 according to the embodiment shown in the drawings, shield plate 9 is positioned around plug insertion opening 5 to cover the entire front surface of connector mold 4. Thus, when an electrostatically charged fingertip is about to be inserted into plug insertion opening 5, the contact between the fingertip and shield plate 9 grounds the electrostatic charge at the fingertip to shield plate 9. Thus, even if the fingertip were to come into contact with pressure-contact end 8*d* of contacts 8U, 8L, the electrostatic charge is prevented from going through pressure-contact end 8*d* and flowing into the internal circuitry connected to contacts 8U, 8L since it is discharged to shield plate 8 before contact can be made.

As the description above makes clear, the invention has a structure that includes a flexible pressure-contact end that can adequately follow the insertion path of the plug section of the connector plug. Abnormal deformations are prevented through the engagement between the center stopper and the engagement surface.

In the invention, the contacts are assembled easily into the connector mold, and the engagement surface is formed easily.

In the invention, the positioning and orientation of the pressure-contact ends of the connectors are very stable, thus providing a highly reliable product.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A connector socket comprising:

a connector mold;

a plug insertion opening on a surface of said connector mold for receiving a plug section of a connector plug;

at least one contact holding chamber in said connector mold;

a pair of contacts disposed within said contact holding chamber;

said pair of contacts facing each other along a direction perpendicular to a length of said connector mold;

said pair of contacts including deformable pressure-contact ends that are pressed into contact with a plug contact of said plug section when said connector plug is inserted into said plug insertion opening;

a center stopper integrally formed on each of said contacts;

said center stopper being on an intermediate portion of said contacts;

said center stopper is wider than an adjacent portion of said contact;

an engagement surface on an inner wall surface of said contact holding chamber; and said engagement surface being positioned to engage said center stopper to resist displacement of said center stopper beyond a predetermined displacement, whereby excessive displacement of said contact during withdrawal of said plug contact is prevented, said at least one contact holding chamber being opened to opposite surfaces of said connector mold;

said at least one contact holding chamber including first and second base attachment grooves extending inward from said opposite surfaces;

said contacts including enlarged base sections; and said enlarged base sections are inserted into said contact holding chamber by sliding in said base attachment grooves through said opposite surfaces.

2. A connector socket as described in claim 1 further comprising:

a stopping projection projecting inside said contact holding chamber;

said contact including an end projection formed integrally on said pressure-contact ends;

said stopping projections being positioned to permit said end projection to be positioned in a rear thereof, whereby said pressure-contact end is prevented from being withdrawn from said contact holding chamber during disengagement of said connector plug from said connector socket.

* * * * *